US008903626B2

(12) United States Patent
Matsuura et al.

(10) Patent No.: US 8,903,626 B2
(45) Date of Patent: Dec. 2, 2014

(54) METHOD OF ADJUSTING A FUEL COMPOSITION ESTIMATE

(75) Inventors: Kenji David Matsuura, Marysville, OH (US); Michael Neisen, Coon Rapids, MN (US)

(73) Assignee: Honda Motor Co., Ltd., Tokyo (JP)

( * ) Notice: Subject to any disclaimer, the term of this patent is extended or adjusted under 35 U.S.C. 154(b) by 790 days.

(21) Appl. No.: 13/168,348

(22) Filed: Jun. 24, 2011

(65) Prior Publication Data

US 2012/0330532 A1 Dec. 27, 2012

(51) Int. Cl.
*F02D 41/00* (2006.01)

(52) U.S. Cl.
CPC .... *F02D 41/0025* (2013.01); *F02D 2200/0612* (2013.01); *F02D 2200/1004* (2013.01)
USPC ..... 701/103; 123/1 A; 73/114.38

(58) Field of Classification Search
CPC ... F02D 19/081; F02D 19/084; F02D 19/085; F02D 19/087; F02D 19/088; F02D 2200/0612; F02D 2200/1002; F02D 41/0025
USPC ..... 123/1 A; 73/114.55, 114.56, 114.38; 701/102, 103, 113
See application file for complete search history.

(56) References Cited

U.S. PATENT DOCUMENTS

| | | | | |
|---|---|---|---|---|
| 4,418,674 | A | 12/1983 | Hasegawa et al. | |
| 4,459,961 | A | 7/1984 | Nishimura et al. | |
| 4,862,369 | A | 8/1989 | Yakuwa et al. | |
| 6,079,396 | A * | 6/2000 | Ament et al. | 123/674 |
| 6,298,838 | B1 | 10/2001 | Huff et al. | |
| 7,032,572 | B2 | 4/2006 | Bidner et al. | |
| 7,314,033 | B2 | 1/2008 | Cohn et al. | |
| 7,448,360 | B2 | 11/2008 | Kita | |
| 7,673,621 | B2 | 3/2010 | Carr et al. | |
| 7,676,321 | B2 | 3/2010 | Andri | |
| 7,774,124 | B2 * | 8/2010 | Streib et al. | 701/101 |
| 7,778,763 | B2 * | 8/2010 | Ueda et al. | 701/104 |
| 8,000,880 | B2 * | 8/2011 | Shibata et al. | 701/104 |
| 8,370,010 | B2 * | 2/2013 | Imamura et al. | 701/103 |
| 2008/0289405 | A1 * | 11/2008 | Schenck Zu Schweinsberg et al. | 73/114.52 |
| 2009/0064969 | A1 * | 3/2009 | Miersch-Wiemers | 123/406.14 |
| 2009/0082947 | A1 | 3/2009 | Tashima | |
| 2009/0306875 | A1 * | 12/2009 | Jiang et al. | 701/102 |
| 2010/0063712 | A1 | 3/2010 | Bromberg et al. | |

FOREIGN PATENT DOCUMENTS

| | | |
|---|---|---|
| JP | 8284708 | 10/1996 |
| WO | 2009004195 | 1/2009 |
| WO | 2009007605 | 1/2009 |

* cited by examiner

*Primary Examiner* — Thomas Moulis
*Assistant Examiner* — Elizabeth Hadley
(74) *Attorney, Agent, or Firm* — Plumsea Law Group, LLC

(57) ABSTRACT

A method is provided for adjusting a fuel composition estimate. The method generally uses a non-fuel related property to determine fuel composition. In some cases the method can be used after refueling and when the engine is operating without the benefit of oxygen sensor data, which can include evaluating data not based on characteristics of the fuel or exhaust from its combustion, such as engine torque variations while using the fuel. The method can include monitoring estimated engine torque to determine whether first variations in engine torque exceed a threshold, and, if so, modifying the previous estimate of fuel composition prior to the refueling event by a pre-determined amount.

17 Claims, 7 Drawing Sheets

METHOD OF ADJUSTING A FUEL COMPOSITION ESTIMATE

BACKGROUND

The present invention relates generally to a motor vehicle, and in particular to a system and method for estimating a composition of the fuel mixture in the vehicle.

Vehicles that can operate using mixtures of different fuel types have been previously proposed. Some vehicles are able to operate on mixtures of gasoline and ethanol. Due to the different combustion properties of gasoline and ethanol, the operation of an engine can be varied according to different types of fuel mixtures. It has previously been proposed to use properties associated with the blended fuel to estimate its composition, such as air-fuel ratio meters or gauges that read the voltage output of a lamda or oxygen sensor exposed to exhaust immediately after combustion of the fuel.

SUMMARY

The term "motor vehicle" as used throughout the specification and claims refers to any moving vehicle that is capable of carrying one or more human occupants and is powered by any form of energy. The term "motor vehicle" includes, but is not limited to: cars, trucks, vans, minivans, SUVs, motorcycles, scooters, boats, personal watercraft, and aircraft.

In some cases, the motor vehicle includes one or more engines. The term "engine" as used throughout the specification and claims refers to any device or machine that is capable of converting energy. In some cases, potential energy is converted to kinetic energy. For example, energy conversion can include a situation where the chemical potential energy of a fuel or fuel cell is converted into rotational kinetic energy or where electrical potential energy is converted into rotational kinetic energy. Engines can also include provisions for converting kinetic energy into potential energy. For example, some engines include regenerative braking systems where kinetic energy from a drivetrain is converted into potential energy. Engines can also include devices that convert solar or nuclear energy into another form of energy. Some examples of engines include, but are not limited to: internal combustion engines, electric motors, solar energy converters, turbines, nuclear power plants, and hybrid systems that combine two or more different types of energy conversion processes.

A method is provided for adjusting a fuel composition estimate of a vehicle after refueling and that can be without the benefit of oxygen sensor data, which can include evaluating data not based on characteristics of the fuel or exhaust from its combustion, such as engine torque variations while using the fuel. The method can include sensing a refueling event and, after sensing the refueling event, determining whether accurate sensor data is presently lacking from a fuel composition sensor, such as an oxygen sensor in the form of a linear air-fuel ratio sensor (LAF).

If accurate sensor data based on characteristics of the fuel or its combustion are presently lacking, the method can include monitoring estimated engine torque to determine whether first variations in engine torque exceed a threshold, and, if so, modifying the previous estimate of fuel composition prior to the refueling event by a pre-determined amount.

Other systems, methods, features and advantages will be, or will become, apparent to one of ordinary skill in the art upon examination of the following figures and detailed description. It is intended that all such additional systems, methods, features and advantages be included within this description and this summary and be protected by the following claims.

BRIEF DESCRIPTION OF THE DRAWINGS

The embodiments and configurations illustrating various features and aspects of the invention can be better understood with reference to the following drawings and description. The components in the figures are not necessarily to scale, emphasis instead being placed upon illustrating the principles of the invention. Moreover, in the figures, like reference numerals designate corresponding parts throughout the different views.

DETAILED DESCRIPTION

Figure 1:
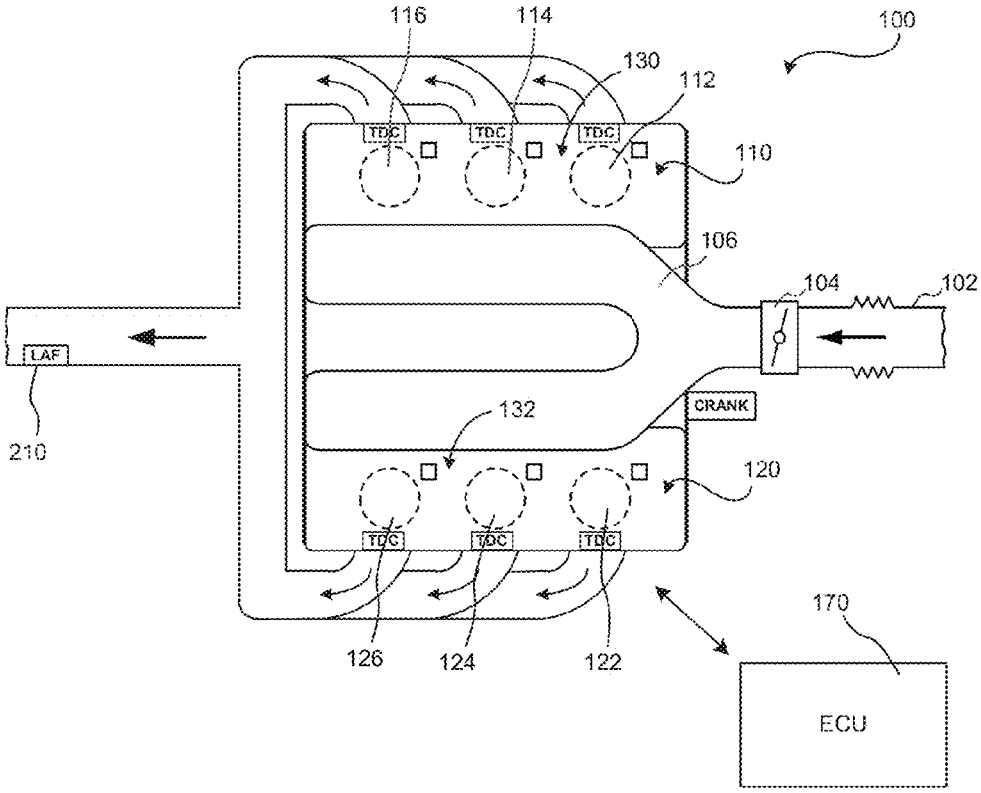
FIG. 1 is a schematic overhead view of an embodiment of an automobile engine showing components related to estimating its fuel composition.

FIG. 1 is a schematic overhead view of some components of a configuration of an example engine 100. Engine 100 can be associated with a motor vehicle of some kind. For the purposes of clarity, engine 100 is illustrated as a V6 engine in the configurations shown, however it should be understood that, in other configurations, engine 100 could include any number of cylinders.

In some cases, engine 100 can be configured to operate using various types of mixed fuels. The term "mixed fuel" as used throughout this detailed description and in the claims, applies to a mixture of two or more fuels. For example, in some cases, a mixed fuel can be a mixture of gasoline and ethanol. Generally, mixtures of gasoline and ethanol can include different proportions of ethanol including, but not limited to: E20, E75, E80 and E85. In other cases, other types of mixed fuels can be used including, but not limited to: methanol and gasoline mixtures, p-series fuels as well as other mixed fuels.

Throughout this detailed description and in the claims, the term "fuel component" refers to any component of a fuel, such as an alcohol, as any other component of a fuel. For example, in an E85 fuel mixture, ethanol comprises about 85% as one fuel component and gasoline comprises about 15% as a second fuel component of the fuel mixture. In some cases, gasoline could be considered as a fuel component as well.

Engine 100 can include first cylinder bank 110 and second cylinder bank 120. The number of cylinders comprising first cylinder bank 110 and second cylinder bank 120 can vary. In some configurations, each cylinder bank can include three cylinders. First cylinder bank 110 can include first cylinder 112, second cylinder 114, and third cylinder 116; and second cylinder 120 can include fourth cylinder 122, fifth cylinder 124, and sixth cylinder 126. In other configurations, each cylinder bank can include four cylinders.

First cylinder bank 110 and second cylinder bank 120 can be associated with various provisions for facilitating combustion. In this configuration, first cylinder bank 110 and second cylinder bank 120 can be associated with first fuel injector set 130 and second fuel injector set 132, respectively. Fuel injector sets 130 and 132 each comprise three fuel injectors in the current configuration, where each injector is associated with a distinct cylinder.

Although they are not depicted in FIG. 1, each of the cylinders comprising cylinder banks can be further associated with other provisions for facilitating combustion. These additional provisions can include, but are not limited to, pistons, cam shafts, intake valves, as well as other components that are necessary for the functioning of engine 100.

Engine 100 can include provisions for receiving air at cylinder bank 110 and cylinder bank 120. Air flowing through intake line 102 can be received into intake manifold 106 by way of throttle 104. In some configurations, intake manifold 106 can be disposed between first cylinder bank 110 and second cylinder bank 120. In some configurations, intake manifold 106 can be configured to distribute air to each of the cylinders comprising cylinder banks 110 and 120.

Figure 2:
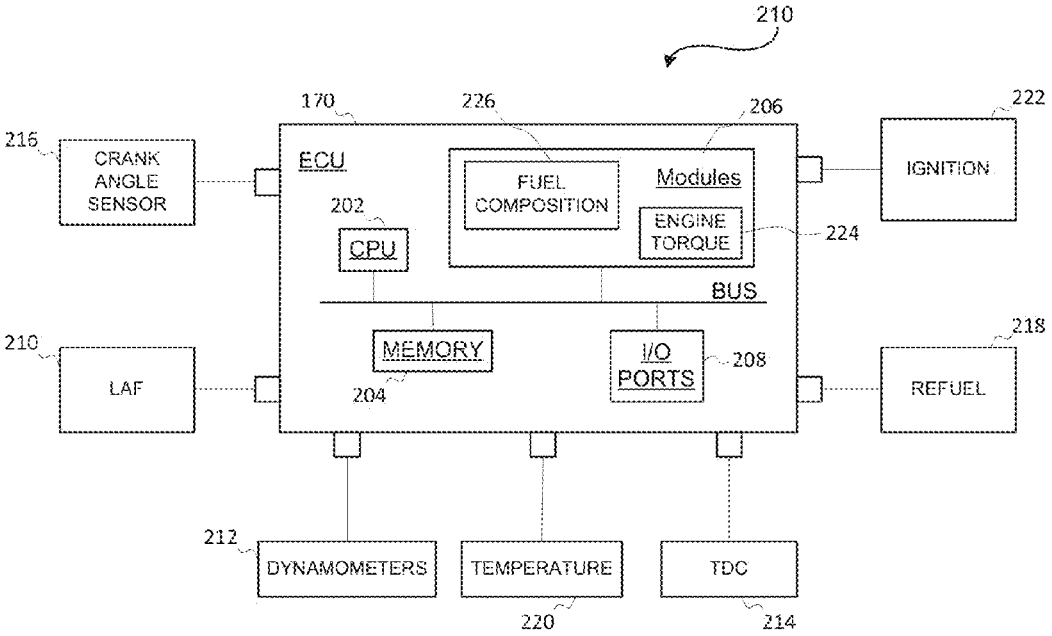
FIG. 2 is a schematic view of an embodiment of an electronic control unit (ECU) of the engine of FIG. 1.

Referring now to FIGS. 1 and 2, in some configurations, ECU 170 can be configured to include a central processing units (CPU) 202, memory 204, modules 206, and to use input/output ports 208 connected to sensors to communicate with various components within a motor vehicle. In some cases, ECU 170 can communicate with a linear air/fuel sensor 210, one or more dynamometers 212, piston sensors 214, a crank angle sensor 216, a refuel sensor 218, and temperature sensor 220. Sensor 220 can comprise one or more sensors and can be connected to one or more components in a motor vehicle to measure temperature information at various positions. Accordingly, ECU 170 can ascertain temperature information from sensor 220 via port 208. For example, in some configurations, a temperature sensor 220 can be disposed proximate LAF 210 to assist with determining when LAF has been warmed sufficiently to an operating temperature at which it can accurately sense the amount of oxygen in the exhaust gases.

ECU 170 can include a number of ports that facilitate the input and output of information and power. The term "port" as used throughout this detailed description and in the claims refers to any interface or shared boundary between two conductors. In some cases, ports can facilitate the insertion and removal of conductors. Examples of these types of ports include mechanical connectors. In other cases, ports are interfaces that generally do not provide easy insertion or removal. Examples of these types of ports include soldering or electron traces on circuit boards.

All of the following ports and provisions associated with ECU 170 are optional. Some configurations can include a given port or provision, while others can exclude it. The following description discloses many of the possible ports and provisions that can be used, however, it should be kept in mind that not every port or provision must be used or included in a given configuration.

In some configurations, ECU 170 can be configured to use one or more ports connected to sensor 190 to communicate with various components within a motor vehicle. In some cases, sensor 190 can comprise multiple sensors located in various parts of the motor vehicle. The multiple sensors can be used for many non-limiting purposes such as temperature information, surface area information, pressure information, and airflow information.

In the current configuration, ECU 170 can be configured to use ports to communicate with components of engine 100 associated with combustion. ECU 170 can communicate with first fuel injector set 130 and second fuel injector set 132 via first port 172.

Generally, fuel injector set 130 and fuel injector set 132 and ECU 170 can be referred to as a "fuel injection system". In this configuration, any type of electronic fuel injection system known in the art can be used. Examples and details of such systems, as well as control methods for the systems, can be found in U.S. Pat. No. 4,418,674 to Hasegawa et al., U.S. Pat. No. 4,459,961 to Nishimura et al., and U.S. Pat. No. 4,862,369 to Yakuwa et al., which are all assigned to Honda Motor Company, and the entirety of which are all incorporated herein by reference.

ECU 170 can ascertain engine speed information from various sensors such as crank angle sensor 216, which measures the rotational speed of the crankshaft. Engine speed can also be ascertained from other optional sensors and electronic controls, such as from the timings of electronic ignition pulses from ignition sensor 222, piston position sensors 214 sensing when pistons reach top dead center (TDC) and/or dynamometers 212 measuring rotation of the flywheel or other rotating parts like a drive shaft.

Refuel sensor 218 can include a sensor proximate the fuel tank opening (not shown) through which an operator will refuel the vehicle. In some cases it can include fuel gages and sensors in or proximate the fuel tank, which can sense fuel levels, tank pressure and changes in fuel levels. It will be appreciated that other ports and associated sensors can be attached to ECU 170 to attain information from engine 100 or other components of a motor vehicle.

In some configurations, ECU 170 can include one or more modules 206 configured for managing various functions. As used herein with respect to the ECU, the term "module" means a logical entity configured to perform a particular function or set of related functions. Thus, in some configurations, modules can refer to software configured to perform certain functions, such as evaluate and estimate engine torque based on various sensor reading and other information like ignition information. In other configurations, modules can refer to hardware, such as specialized processing units configured to perform certain functions, which can also include evaluating and estimating engine torque based on sensor readings and other data. Further, it is understood that ECU 170 can refer to a logical entity that can include multiple processing entities that are interconnected for communication with one another and that can functionally act as single master control unit.

FIG. 2 includes two modules 206 related to evaluating fuel composition. Fuel mixture module 224 can include physical circuits and/or software configured for estimating the composition of fuel for the vehicle. In many configurations, fuel mixture module 224 can be directed to determining the percentage of ethanol for a blended fuel vehicle. As discussed later herein, oxygen sensor readings from linear air fuel ratio (LAF) sensor 210 (FIG. 1) can provide data for accurate estimation of the percent ethanol in a blended fuel being used based on the amount of oxygen it senses directly from the exhaust gases. Although LAF readings can provide very accurate estimates of fuel composition, oxygen sensors can require a period of time to warm to an appropriate operating temperature range, which can deprive the system of important information for evaluating fuel composition when a vehicle is initially started prior to the LAF reaching its operating temperature. As will be discussed further, other information, such as engine speed and estimated torque information can also assist with estimating fuel composition—particularly in the absence of LAF data.

Engine torque module 226 can likewise act as a logical functional entity, whether configured as physical circuitry directed to the same, software, or a combination of specialized software and hardware. In some configurations, engine torque module 226 can receive various types of information for providing estimates of the engine torque, such as engine speed information from sensors like the crank angle sensor, ignition information from electronic ignition unit 222, and dynamometers 212 disposed on rotating parts like the flywheel or drive shaft. These various types of sensor data and other information can be evaluated by engine torque module 226 to provide accurate estimates of engine torque during engine operation. In one configuration, engine torque can be estimated based on crankshaft acceleration and/or deceleration data, such as acceleration and/or deceleration data from the combustion/power stroke portion of the engine cycle.

Engine 100 can also include provisions for communicating (and in some cases controlling) the various components associated with engine 100. In the current configuration, engine 100 can be associated with electronic control unit 170, hereby referred to as ECU 170. In some configurations, ECU 170 can be a computer or similar device associated with a motor vehicle, and, as noted above, can include various modules or processing entities that cooperate to act as an overall control unit.

Generally, ECU 170 can be configured to communicate with additional components of engine 100 not shown in the Figures. ECU 170 can communicate with any number of components, including, for example, intake valves, exhaust valves, as well as other components used for controlling combustion known in the art. In other configurations, multiple electronic control units can be used. In these other configurations, each control unit can be associated with one or more components and in communication with one another.

ECU 170 can be configured to control the amount of fuel injected into each cylinder so that the efficiency of combustion is maximized. ECU 170 can monitor multiple parameters associated with engine 100 and determine the amount of fuel that should be injected. Because the amount of fuel injected into a cylinder is determined by the length of time each fuel injector is opened, ECU 170 can determine a fuel injection duration according to multiple engine parameters.

In some configurations, ECU 170, fuel injector set 130, fuel injector set 132, sensor 150, sensor 190, sensor 192, and sensor 194 can be referred to collectively as air/fuel ratio control apparatus 199, or simply control apparatus 199. In some cases, control apparatus 199 includes provisions for controlling the air/fuel ratio of one or more cylinders in engine 100. Some configurations can include additional components not shown in the current configuration. In addition, in other configurations some provisions included in the current configuration can be optional.

Figure 3:
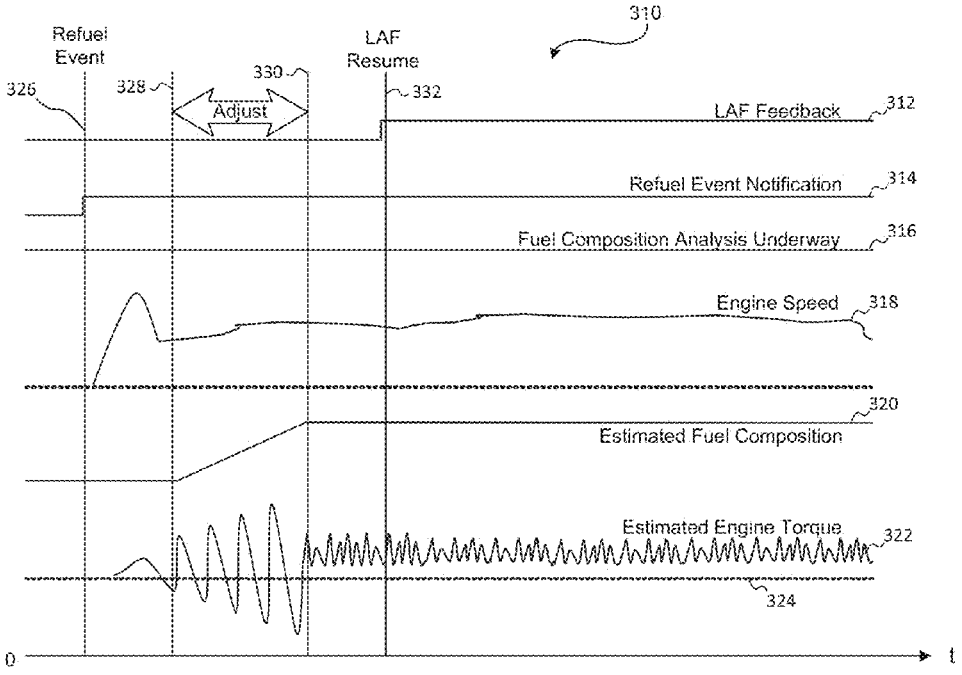
FIG. 3 shows an embodiment of a general timeline of events along with engine sensor feedback related to a change in fuel composition for example scenarios involving estimating fuel composition for the engine of FIG. 1.

Referring now to FIG. 3, a general timeline of events is shown along with engine sensor feedback related to a change in fuel composition for example scenarios involving estimating fuel composition. Many vehicles can operate using regular gasoline, as well as various types of blended fuels, such as fuels formed from a blend of gasoline and predominantly ethanol (e.g., around 85% ethanol in some cases). Due to the effect on performance that differing blends of fuels can have on the engine of these vehicles, it can be beneficial for the engine ECU to have correct fuel composition estimates, such as the ethanol concentration in the fuel being supplied to the engine, to allow the ECU to make appropriate adjustments based on the fuel composition. An ethanol concentration estimation can be particularly helpful for A/F (air fuel ratio) control, because the amount of fuel needed for stoichiometric operation increases with increasing ethanol concentration.

It can beneficial in many cases for the ECU to have accurate fuel composition estimates, such as right after engine start, because there is a delay in the start of linear air fuel ratio (LAF) sensor feedback due to LAF sensor warm up time. If the ethanol concentration is underestimated during this open loop feedback portion of operation, the engine can operate in a lean condition, which can cause the engine non-optimally, even to stall. Situations like these and the risk of stall or misfires at such times due to the ECU incorrectly estimating fuel composition can be compounded even more if changes to fuel composition are made (e.g., during vehicle refueling) without the ECU having an opportunity to accurately estimate the fuel composition.

Figure 4:
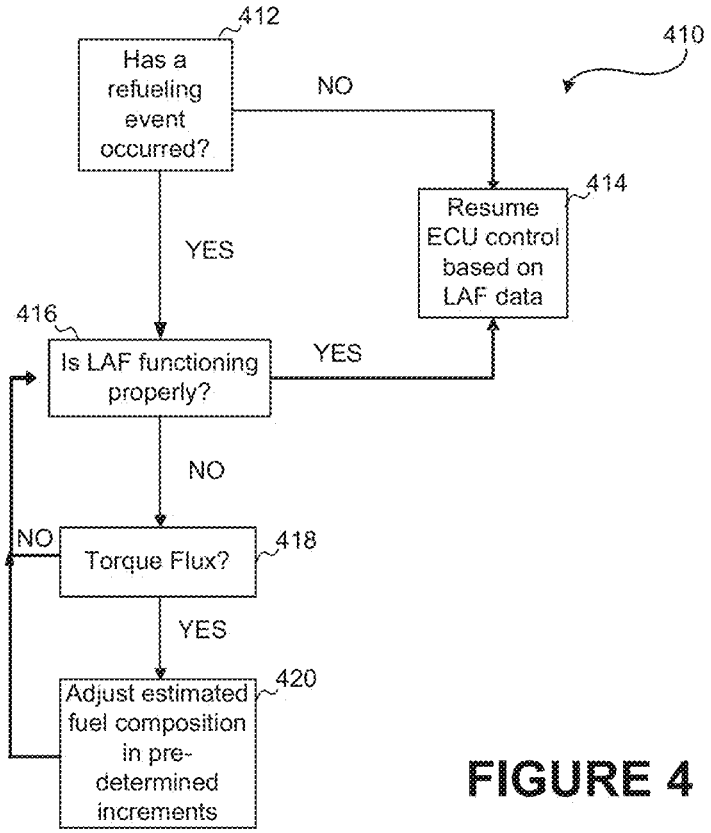
FIG. 4 is an embodiment of a flow chart related to a method for adjusting a fuel composition estimate, which is discussed above along with the scenarios and examples of FIG. 3.

FIG. 3 graphically illustrates these types of situations and scenarios of relatively high risk of the ECU providing engine operation instructions that could be based on inaccurate fuel composition estimates. In addition, it graphically illustrates various inventive features pertaining to methods, systems and/or software for reducing the risk of misfire, stall or poor vehicle performance. Similarly, FIG. 4 illustrates steps of an embodiment of an inventive method for estimating fuel composition. In some embodiments, the method shown in FIG. 4 can occur along with the general scenario described along with FIG. 3.

For the general scenario of FIG. 3, assume that a user has refueled a vehicle, such as a vehicle including features discussed above with FIGS. 1 and 2, with the engine turned off and unable to have learning time to detect and properly estimate the composition of the fuel after refueling. Reference line 326 represents such a refueling event sensed by the ECU, such as via changes in fuel change levels, changes in fuel tank pressure and/or sensing removal/opening of the fuel tank cover. Based on this information, the ECU determines the user has refueled the vehicle and did not allow sufficient time for the ECU to learn revised fuel composition. Assume further that poor combustion occurs moving to the right of line 326 and forward in time due to inaccurate fuel composition estimates, such as inaccurate estimates for ethanol concentration.

The horizontal lines in FIG. 3 pertain to data communicated with the ECU along with the general scenario described here after. Top line 312 represents a status indication provided by the linear air-fuel sensor LAF 210 to the ECU 170 (See FIG. 1). The upward "step" in line 312 proximate vertical time reference line 332 indicates a change in status notification being sent from LAF 210 to ECU 170 as the LAF warms up and becomes operable. Horizontal line 314 represents a Refuel Event notification from sensor or module identifying a refueling event, such as a fuel cover sensor (not shown), a fuel tank pressure sensor (not shown) or a fuel tank level sensor (not shown) providing notification of the refuel event to the ECU. Notably, line 314 includes an upward "step" proximate vertical time reference line 326 identifying the refuel event.

Horizontal line 318 represents the engine speed, which can be provided from a crank angle sensor to the ECU. As indicated on the chart for FIG. 3, the engine speed quickly increases shortly after refueling event 326 indicating the vehicle was started shortly thereafter and returned to operation. Horizontal reference line 320 represents the status of estimated ethanol concentration in the fuel after refueling. As will be discussed further along with FIGS. 4 and 7, in some cases, the estimated ethanol concentration can be steadily increased based on evaluation of torque fluctuations to improve engine operation while the LAF is inoperable. As such, estimated ethanol concentration line 320 steadily increases between vertical time reference lines 328 and 330 while the status of LAF is identified as inactive. Vertical time reference line 328 represents an event of estimated torque fluctuation exceeding a threshold, which could also have been accompanied by and triggered by a misfire event or some other engine operation abnormality.

Vertical time reference line 330 indicates stabilization of estimated torque variation due to the increases in the estimated ethanol concentration. Correspondingly, horizontal plot line 322 represents estimated engine torque, which greatly fluctuates between event 328 when the estimate torque fluctuation exceeded a threshold value and event 330 when the estimated torque fluctuations stabilize in response to modifying the estimated ethanol concentration in the fuel after the refueling event 326.

The general scenario of FIG. 3 can be evaluated along with FIG. 4, which shows some aspects of an embodiment of a method 410 for estimating fuel composition in the absence of sensor data that is related to features of the fuel or its combustion. Step 412 of the method relates to a step in which the ECU receives notification that a refueling event has occurred, such event 326 in FIG. 3. In some configurations, if a refueling event had not occurred, the method would proceed to step 414 of the ECU resuming engine control according to its history, calculations and ongoing interactions with the LAF. If a refueling event had occurred, the method would proceed to include step 416 of determining whether the LAF is functioning property, which may not be the case when the engine is restarted until the LAF has sufficient time to warm up and ensure accurate measurements.

If the LAF is functioning properly, method 410 can proceed to step 414 discussed above. However, if the LAF is not operable, such as immediately after starting the vehicle, method 410 can proceed to step 418 and performs actions related to evaluating whether the estimated engine torque flux exceeds a threshold value. In some cases, the threshold value can be a predetermined amount of estimated fluctuations in engine torque that would exceed a stable combustion limit. In some configurations, such limits could be predetermined by the manufacturer to avoid performance problems with the engine or potentially damaging it by operating it under unstable combustion parameters. In other configurations, the threshold values could be determined by the ECU over time based on historical engine performance. For instance, the ECU could track events such as stalls, misfires and rough engine operation that indicate unstable operating parameters, and base its threshold values on the same. In some configurations, a misfire or stall event shortly after a refueling event and while the LAF is inoperable could be considered meeting a threshold value for proceeding to estimate the fuel configuration without the benefit of sensor data based on sensed characteristics of the fuel, such as LAF sensing oxygen levels in the exhaust immediately after combustion of the fuel.

If the estimated torque fluctuations vary enough to cross a predictive threshold level, the method proceeds to step 420 of adjusting the estimated ethanol concentration. In some cases, step 420 can be done in an incremental, iterative manner and in some configurations it can include pre-determined increments for some of the adjustments. Related aspects and features pertaining to estimated torque fluctuations are discussed later along with FIG. 7 and method 710.

Figure 5:
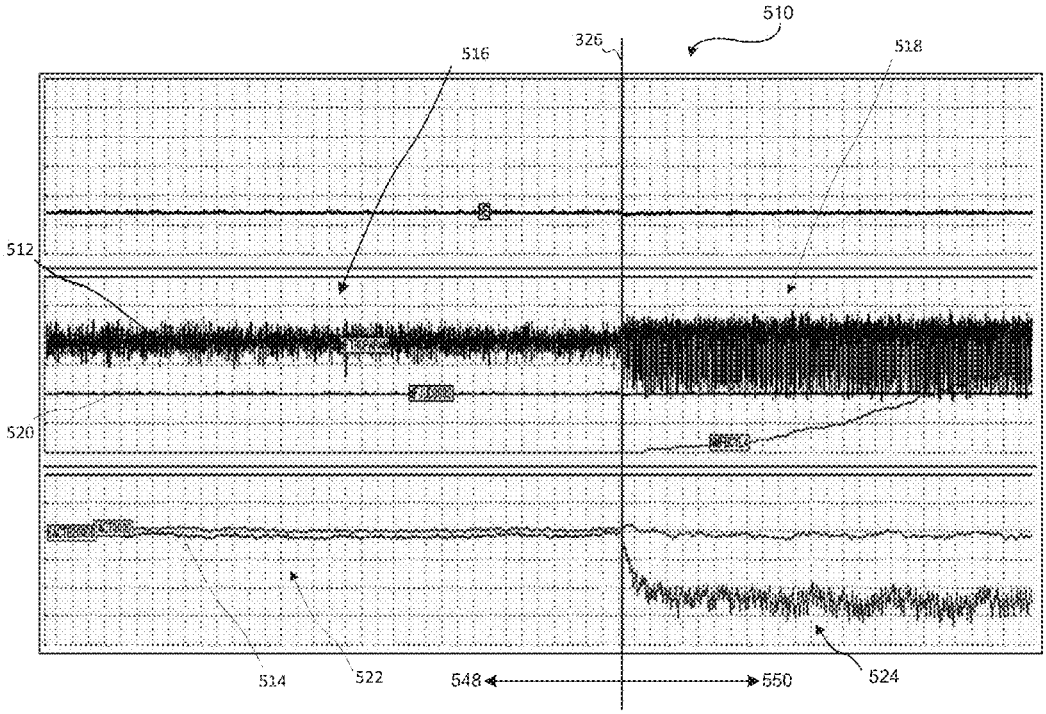
FIG. 5 is an embodiment of a set of time-series plots for sensed and derived information related to operation of the engine of FIG. 1 during example scenarios that are discussed along with FIGS. 2-4 involving changes in fuel composition and estimation of fuel composition.

Referring now to FIG. 5, a set of time-series plots are shown showing estimated torque values, fluctuation of the torque values, and combustion values during operation of a vehicle, such as example vehicles discussed above along with FIGS. 1-4. Further, the plots generally correspond with the example scenarios discussed above with FIGS. 3 and 4 of a vehicle operating under stable conditions via control of the ECU acting in accordance with oxygen readings from the LAF sensor for estimating the fuel configuration, which refuels and operates for a period with an unknown fuel composition estimate after refueling and without the benefit of LAF sensed data.

In some configurations, the ECU can determine based, for example, on baseline engine information and/or historical operational information, an amount of engine torque being produced to judge misfire. The ECU can establish such a low limit on torque, or a safer value above that low limit, as a threshold value that if crossed may indicate inaccurate fuel composition estimates or indicate other performance problems. If the ECU estimated torque value exceeds a lower limit, the ECU can judge that poor combustion has occurred and judge it as a misfire. Further, a lean condition on engine start after mislearning the fuel composition, such as the ethanol concentration, can be detected by large fluctuations in the estimated torque value. As such, in many configurations, fluctuations in estimated torque values, low torque values proximate misfire events and/or misfire events themselves can be considered as threshold traversing events indicating the fuel composition estimation may be inaccurate.

Chart 510 of FIG. 5 primarily shows an embodiment including two plotlines extending generally horizontally across the chart. The upper line 512 is a plot of estimated torque values over a period of time including a refuel event 326 occurring as indicated by vertical line 616. The portion of upper line 512 to the left of refuel event 326 is denoted as 516 and the portion to the right is denoted as 518. The lower line 514 represent average combustion values across the cylinders over the same period of time. The portion of combustion line 514 prior to the refuel event is denoted as 522 and the portion to the right is denoted as 524. Horizontal line 520 identifies a lower limit of estimated torque value at which the ECU anticipates misfire events may likely occur.

As shown on chart 510 consistent with the scenario discussed above with FIGS. 3 and 4, the engine operates in a stable manner prior to refuel event 326 based on accurate fuel composition estimates determined in accordance with data from the LAF. Thus, the torque values have little variation prior to the refuel event in comparison with afterward and none of the torque values appear to get close to lower limit 520. Similarly, the average cylinder combustion values 514 are stable, remain close to maximum values, and indicate stoichiometric operation prior to the refuel event.

Immediately after refuel event 326, while operating under inaccurate fuel composition estimates and without the benefit of LAF sensor values, the engine performance degrades significantly. In particular, the torque values in 518 vary greatly and often exceed lower limit 520 indicating many misfire events. Likewise, the average combustion values drop significantly and vary greatly indicating rough and inefficient operation of the engine. Such poor performance of the engine continues for a period of time until the LAF reaches it appropriate operating temperature and can provide sensed information related to composition of the fuel post refuel and information about its combustion provided by the exhaust. Relying primarily on sensor information that is based on characteristics of the fuel itself in order to estimate its composition with sufficient accuracy sets up a repeating series of such scenarios during which the engine will run rough for a period of time.

In some scenarios, this period of rough engine performance occurring while the LAF is reaching an appropriate operating temperature could be as long as 3-5 minutes at an idle operating condition, such when starting the engine after a refueling event in a cold temperature climate (e.g., about −30° C.). In some configurations, the determination for when the LAF has reached an appropriate operating temperature can be based on engine water temperature readings. Rough engine operation during such a warm-up period after a re-fueling event can cause unnecessary wear and potentially cause avoidable maintenance issues, which can be avoided in accordance with the inventive methods and features discussed herein.

Figure 6:
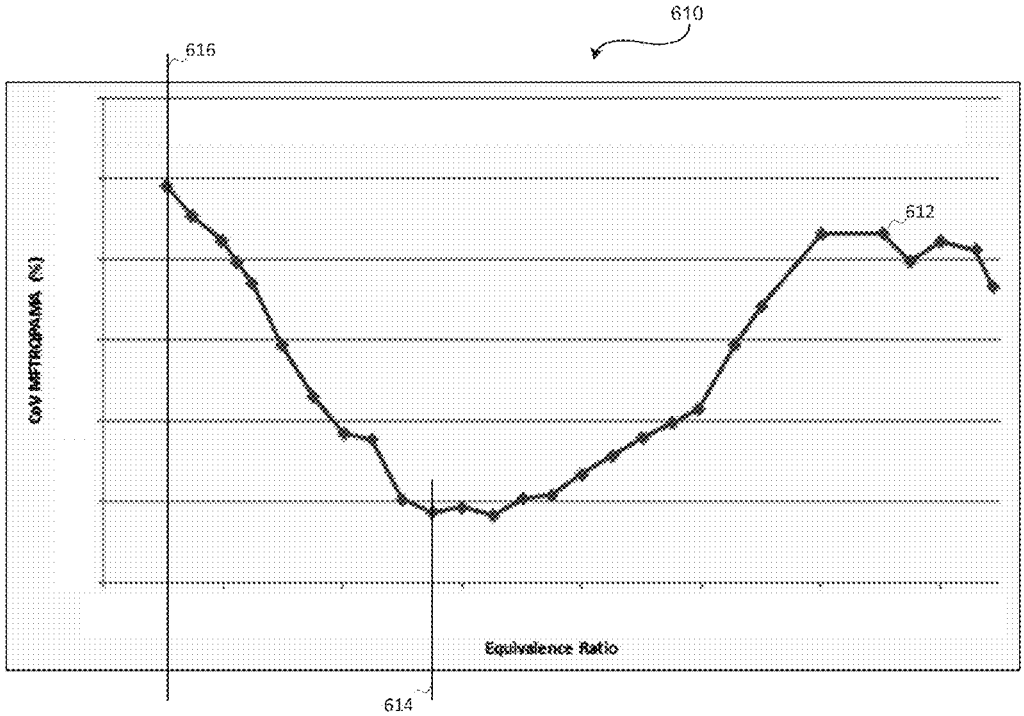
FIG. 6 is an embodiment of a chart illustrating example relationships between proper and improper air-fuel mixtures during operation of the engine of FIG. 1 with respect to fluctuations in estimated engine torque as evaluated through analysis of covariance of the estimated engine torque for the changes in air-fuel mixtures.

FIG. 6 is a chart 610 illustrating example relationships between proper and improper air-fuel mixtures during operation of an engine with respect to fluctuations in estimated engine torque as evaluated through analysis of covariance of the estimated engine torque for the changes in air-fuel mixtures. Line 612 shown thereon is an example plot of the co-variance of the estimated torque value for an example fuel system. As shown below, the co-variance of torque value is also a good indication of combustion instability that can be used in some configurations to assist with modifying estimating fuel composition values or identifying the need to do so without waiting for additional information, such as from the LAF. In some configurations, a running sample of the estimated engine torque can be stored in the ECU's memory, and the mean and standard deviation of the running sample can be used to calculate co-variance of torque.

The graph illustrates that, as the air-fuel mixture (expressed by equivalence ratio) gets leaner or richer, the co-variance of estimated engine torque increases. Vertical line 614 generally relates to an equivalence value of 1.0, at which point there is very little co-variance of estimated torque values. However, regardless of whether combustion begins to run leaner or richer due, for example, to inaccurate fuel composition estimates, the covariance of estimated torque increases. As such, in some configurations, the absolute value of estimated engine torque can be used as another threshold value or indicator for the need to estimate fuel composition based on factors other than characteristics of the fuel or its combustion, such as engine performance characteristics, and provide more accurate fuel composition estimates quicker than may be available according to information sensed from the exhaust via the LAF.

Figure 7:
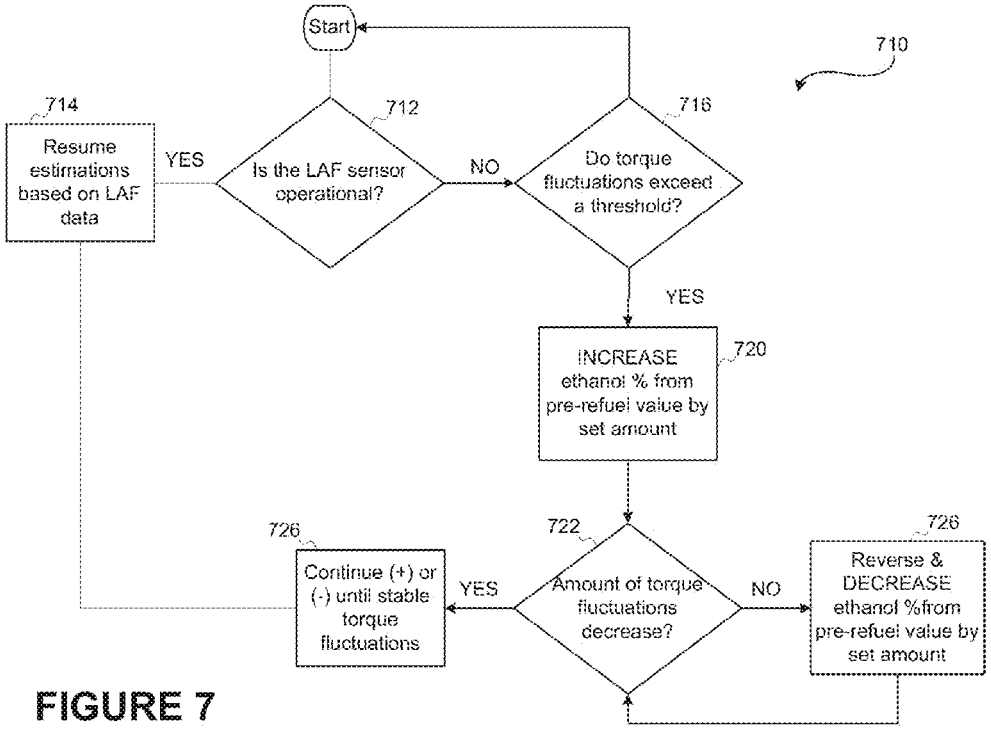
FIG. 7 is an embodiment of a flow chart illustrating aspects of a method for estimating fuel composition including considerations regarding estimated engine torque.

Referring now to FIG. 7, a method 710 is shown for estimating fuel composition based on fluctuations of estimated torque values during operation of the engine. As discussed above, it can be very beneficial in various circumstances to estimate fuel composition values soon after a change in fuel composition and, in particular, prior to the LAF being operational and having an opportunity to provide sensed data. Method 710 includes a step 712 of determining whether the LAF sensor is operational. If yes, the method can proceed to step 714 of resuming fuel composition based primarily on data sensed by the LAF sensor and end. If the LAF is not operational, such as when the vehicle is started and the LAF has not warmed to proper operating temperatures, the method proceeds to step 716 of determining whether the torque fluctuations exceed a threshold.

As noted above, various threshold values can be established for differing configurations, which can include high covariance of estimated torque values, low torque values and/or misfire events. If the torque fluctuations do not exceed a threshold, the method returns to step 712. However, if the torque fluctuations do cross a threshold parameter, the method proceeds to step 720 of increasing the estimated ethanol percentage from its current value (likely it's pre-refuel estimated value) by a pre-determined amount. In some configurations, an ethanol percentage correction factor can be adjusted every time an injector fires, so the amount of initial adjustment may not need to be very large. The ethanol percentage correction factor could be a percentage increase or decrease in the estimated percentage of ethanol in the fuel. In some configurations, the ethanol percentage correction factor could be an amount up to about a 10% increase or decrease in the estimated percentage of ethanol in the fuel, but it could also be much smaller.

In some configurations, the pre-determined amount can be an amount set by the vehicle manufacturer as a baseline amount for incremental estimate adjustments. In other configurations, the pre-determined amount can be set by the ECU based on historical information for the vehicle and typical fuel compositions obtained by the user. In alternative configurations, rather than initially increasing the ethanol percentage, the method can include initially decreasing the ethanol percentage. In still other configurations, step 720 can include either increasing or decreasing the estimated ethanol percentage based on factors such as historical information, the pre-refueling estimated ethanol percentage (e.g., it may be better to decrease the estimate if the pre-refuel value was relatively high) and/or location information (e.g., certain localities can likely provide fuel having higher or lower ethanol percentages).

After making a first adjustment to the estimated ethanol percentage, method 710 can proceed to step 722 of determining whether the amount of torque fluctuations decreases (improve) in response to the initial adjustment. If the estimated amount of torque fluctuations increases, the method can include the step 724 of adjusting in the opposite direction and decreasing the ethanol percentage by the pre-determined amount added with step 720 and decreasing it further by a second amount, which can also be a pre-determined amount. However, if the estimated amount of torque fluctuations decreases after the initial adjustment, the method can proceed to step 726 of continuing to increase and/or decrease the estimated ethanol concentration until the amount of torque fluctuations stabilize or the LAF returns to operational status.

While various configurations have been described, the description is intended to be exemplary, rather than limiting and it will be apparent to those of ordinary skill in the art that many more configurations and implementations are possible that are within the scope of the invention. Accordingly, the configurations are not to be restricted except in light of the attached claims and their equivalents. Also, various modifications and changes can be made within the scope of the attached claims.

What is claimed is:

1. A method of adjusting a fuel composition estimate for a vehicle, the method comprising:

sensing a refueling event;

after sensing the refueling event, determining whether an air-fuel ratio sensor is operable to provide an updated estimate of fuel composition; and providing an updated fuel composition estimate if the air-fuel ratio sensor is not operable, including performing steps comprising:

monitoring estimated engine torque to determine whether first variations in engine torque over a first period after the refueling event exceed a threshold; and modifying a previous first fuel composition estimate prior to the refueling event by a first pre-determined amount to determine a second estimate of fuel composition if the first variations in engine torque exceed the threshold after the refueling event and while the air-fuel ratio sensor is not operable for providing an updated fuel composition estimates;

the method further comprising:

modifying the second estimate of fuel composition by a second amount if, after performing the step of modifying the first estimate of fuel composition by the first pre-determined amount, second variations of engine torque again exceed the threshold; and wherein the step of modifying the second estimate of fuel composition by the second amount comprises:

comparing the first variations in engine torque prior to a first correction with the second variations in engine torque occurring after determining the second estimate of fuel composition for the first correction; and modifying the second estimate of fuel composition by a second pre-determined amount that is substantially the same as the first pre-determined amount to obtain a third estimate of fuel composition if the first variations and the second variations are substantially the same.

2. The method of claim 1, wherein the step of modifying the second estimate of fuel composition by a second amount further comprises:

modifying the second estimate of fuel composition by a second amount that is less than the first-determined amount to obtain the third estimate of fuel composition if the second variations in engine torque are less than the first variations in engine torque.

3. The method of claim 2, wherein the second amount is determined to be a fraction of the first pre-determined amount corresponding with a ratio of the second variations in engine torque compared with the first variations in engine torque.

4. The method of claim 1, wherein the step of modifying the second estimate of fuel composition by a second amount further comprises:

modifying the second estimate of fuel composition to make corrections in an opposite direction by reducing it by the first pre-determined amount and also reducing it by a second amount if the second variations in engine torque are greater than the first variations in engine torque.

5. The method of claim 4, wherein the second amount is about the same as the first pre-determined amount.

6. The method of claim 1, further comprising:

returning to estimating fuel composition based on air-fuel sensor data if the air-fuel sensor becomes operable to provide data for an updated fuel composition estimate.

7. The method of claim 1, wherein the fuel is a blended fuel formed from a combination of fuel types, the blended fuel having a composition of more than 50% ethanol, and the air-fuel sensor including an oxygen sensor disposed along a post-combustion exhaust path of the engine.

8. The method of claim 7, wherein the step of determining whether the air-fuel sensor is operable includes determining whether the oxygen sensor is sufficiently warmed to provide accurate readings.

9. The method of claim 7, wherein the threshold for the first variations and the second variations in engine torque are substantially the same.

10. The method of claim 7, wherein the threshold for the first variations and the second variations in torque is based on a pre-determined stable combustion limit of torque for the engine.

11. The method of claim 10, wherein the threshold for the first variations and the second variations in torque is a percentage of the pre-determined stable combustion limit of torque.

12. The method of claim 10, wherein the threshold for the first variations and the second variations in torque is substantially the same as the pre-determined stable combustion limit of torque.

13. The method of claim 7, wherein the threshold comprises a misfire event occurring.

14. A vehicle comprising:

an engine configured to operate using a blended fuel;

an air-fuel sensor configured to sense a characteristic of the blended fuel;

a plurality of system sensors configured to sense actions related to operation of the engine; and an electronic control unit (ECU) in communication with the air-fuel sensor and the plurality of system sensors, the ECU having a processing unit, memory and a storage medium for storing computer-related instructions for instructing the processing unit to perform actions comprising:

receiving information from a refueling sensor;

determining a refueling event has occurred;

determining whether an air-fuel ratio sensor is operable to provide an updated estimate of fuel composition, and if the air-fuel ratio sensor is not operable to provide an updated estimate of fuel composition, performing steps comprising:

monitoring estimated engine torque to determine whether first variations in engine torque over a first period after the refueling event exceed a threshold; and modifying a previous first fuel composition estimate prior to the refueling event by a first pre-determined amount to determine a second estimate of fuel composition if the first variations in engine torque exceed the threshold after the refueling event and while the air-fuel ratio sensor is not operable for providing an updated fuel composition estimates;

wherein the storage medium for storing computer-related instructions includes instructions to perform further actions comprising:

modifying the second estimate of fuel composition by a second amount if, after performing the step of modifying the first estimate of fuel composition by a pre-determined amount, second variations of engine torque again exceed the threshold;

comparing the first variations in engine torque prior to a first correction with the second variations in engine torque occurring after determining the second estimate of fuel composition for the first correction; and modifying the second estimate of fuel composition by a second pre-determined amount that is substantially the same as the first pre-determined amount to obtain a third estimate of fuel composition if the first and second variations are substantially the same.

15. The vehicle of claim 14, wherein the storage medium for storing computer-related instructions includes instructions to perform further actions comprising:

modifying the second estimate of fuel composition to make corrections in an opposite direction by reducing it by the first pre-determined amount and also reducing it by a second amount if the second variations in engine torque are greater than the first variations in engine torque.

16. A computer-readable medium having stored thereon computer-readable instructions, which, when executed by an electronic control unit of a motor vehicle provides instructions to perform actions comprising:

sensing a refueling event;

determining whether an air-fuel ratio sensor is operable to provide an updated estimate of fuel composition after sensing the refueling event and, if the air-fuel ratio sensor is not operable to provide an updated estimate of fuel composition after sensing the refueling event, performing steps comprising:

monitoring estimated engine torque to determine whether first variations in engine torque over a first period after the refueling event exceed a threshold; and modifying a previous first fuel composition estimate prior to the refueling event by a first pre-determined amount to determine a second estimate of fuel composition if the first variations in engine torque exceed the threshold after the refueling event and while the air-fuel ratio sensor is not operable for providing an updated fuel composition estimates;

wherein the computer-related instructions include further instructions to perform actions comprising:

modifying the second estimate of fuel composition by a second amount if, after performing the step of modifying the first estimate of fuel composition by a pre-determined amount, second variations of engine torque again exceed the threshold;

comparing the first variations in engine torque prior to a first correction with the second variations in engine torque occurring after determining the second estimate of fuel composition for the first correction; and modifying the second estimate of fuel composition by a second pre-determined amount that is substantially the same as the first pre-determined amount to obtain a third estimate of fuel composition if the first and second variations are substantially the same.

17. The computer-readable medium of claim 16, wherein the computer-related instructions include further instructions to perform actions comprising:

modifying the second estimate of fuel composition to make corrections in an opposite direction by reducing it by the first pre-determined amount and also reducing it by a second amount if the second variations in engine torque are greater than the first variations in engine torque.

* * * * *